United States Patent [19]

D'Angelo

[11] Patent Number: 4,598,648

[45] Date of Patent: Jul. 8, 1986

[54] FIRE FAILURE SAFETY CONTROL FOR STOKERS

[76] Inventor: Joseph T. D'Angelo, 523 E. Mahanoy Ave., Mahanoy City, Pa. 17948

[21] Appl. No.: 747,198

[22] Filed: Jun. 21, 1985

[51] Int. Cl.[4] ..... F23N 5/24

[52] U.S. Cl. ..... 110/193; 110/101 C; 110/185; 236/14; 236/15 BA

[58] Field of Search ..... 110/185, 193, 101 C; 431/69; 236/14, 15 BA

[56] References Cited

U.S. PATENT DOCUMENTS

| | | | |
|---|---|---|---|
| 2,200,326 | 5/1940 | Bressler | 110/186 X |
| 2,393,680 | 1/1946 | Hallihan | 110/101 C |
| 2,483,847 | 10/1949 | Sagar | 110/101 C |
| 3,938,939 | 2/1976 | MacAskill, Jr. et al. | 431/69 X |
| 4,311,102 | 1/1982 | Kolze et al. | 110/186 X |
| 4,517,902 | 5/1985 | Christian | 236/15 BA |

*Primary Examiner*—Edward G. Favors

*Attorney, Agent, or Firm*—Biebel, French & Nauman

[57] ABSTRACT

A control circuit for a stoker-fed heating system is effective, whenever the primary sensing control (thermostat or aquastat) of the system calls for heat, to determine whether there is sufficient fire in the furnace to assure maintained combustion, and if this is not the case, to shut the system down until combustion is again assured.

8 Claims, 1 Drawing Figure

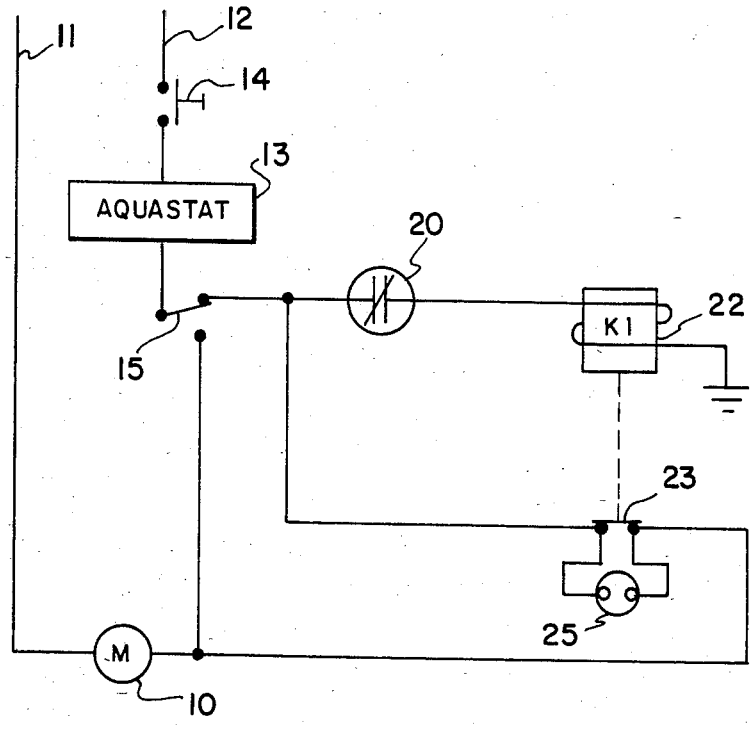
11
12
14
13
AQUASTAT
20
22
K1
15
23
25
M
10

FIRE FAILURE SAFETY CONTROL FOR STOKERS

BACKGROUND OF THE INVENTION

In order for a stoker-fed coal furnace to operate properly, there must always be sufficient fire in the furnace to assure combustion of the additional coal supplied by the stoker. Under normal operating conditions, the aquastat room thermostat or other temperature-sensing will activate the stoker at intervals of sufficiently short duration to assure that additional fuel will be called for before the fire has reached so low a level as not to be capable of igniting the fresh fuel. Similarly, when a stoker-fed furnace is being started up after being out, it is essential that the first batch of fuel fed to the furnace be thoroughly ignited in order to assure continued operation thereafter.

On either such occasion, if adequate combustion is not obtained, the aquastat or other sensing device which initially called for heat will continue to do so, and the stoker will therefore continue to feed additional and unneeded coal into the furnace and thus overload the cold furnace with unburned fuel.

SUMMARY OF THE INVENTION

It is accordingly the primary purpose of the present invention to provide a control circuit which is effective, whenever the primary sensing control of a stoker-fired heating system calls for heat after an interval during which the furnace was on "stand by" with the stoker not operating, to determine whether there is sufficient fire in the furnace to assure maintained combustion, and if this is not the case, to shut the system down until combustion is again assured.

More specifically, the invention provides a system wherein, whenever the aquastat or other main sensing control calls for heat—either in the course of normal operation or when the furnace is being started up—a special control unit determines whether there is sufficient fire in the furnace to maintain combustion and normal operation, and then either shuts the system down and signals the shut-down, or leaves the system under normally maintained control operation.

BRIEF DESCRIPTION OF THE DRAWING

The single FIGURE is a wiring diagram illustrating a preferred embodiment of the invention.

DESCRIPTION OF THE PREFERRED EMBODIMENT

In the drawing, the power supply for the stoker motor 10 comprises lines 11 and 12, and the element 13 represents a sensing control of the usual type for initiating operation of the stoker, which is shown as the aquastat in a hot water system, but which could also be a room thermostat. There is also a main off-on manual switch 14 for the system as a whole, and the manual switch 15 is shiftable between an "up" position in which it connects line 12 into the control circuit of the invention, and a "down" position in which it by-passes that control circuit and directly completes the power circuit to the stoker motor 10.

In that circuit, the switch 20 is a normally closed heat sensor switch which opens upon exposure to a predetermined temperature, one example of a switch which has been used satisfactorily for this purpose being identified as Honeywell LA 409A. In accordance with the invention, the switch 20 should be installed in the location where it can directly sense the temperature inside the furnace, e.g. in the stack.

The relay 22 is a time delay relay which energizes a predetermined time after its energizing circuit has been closed, e.g. 4 to 5 minutes. An example of a commercially available product suitable as the relay 22 is identified as AMF Potter Brumfield CVF-42-70120, Time Delay on Operation, External Resistance Adjustable. The contacts 23 of relay 22 are normally closed, and a signal device 25 is connected around the contacts 23 for operation when those contacts are open, satisfactory results having been obtained with the signal 25 being a 125-volt neon lamp or an audible signal of comparable power.

FIG. 1 shows the circuit with the manual control switch 14 open and power therefore turned off. Under these conditions, the sensor switch 20 is closed, but with no energizing power to relay 22, it remains dead and its contacts 23 are closed. When switch 14 is closed to put the system in operation, conditions will remain the same unless the aquastat 13 is calling for heat, and in this event, the energizing circuit for relay 22 is completed, but due to its time delay properties, its contacts 23 remain closed to maintain the energizing circuit to the stoker motor 10.

These conditions remain for the time delay period of relay 22. If the stoker is just being started up with no fire in the furnace, the time delay provides for ignition of the initial supply of coal in the furnace. The relay 22 is chosen to provide a time delay long enough for combustion to develop sufficiently to raise the stack temperature above the level to which the sensor switch 20 responds by opening its normally closed contacts in the energizing circuit to relay 22. Preferably, however, the switch 15 should be in its down position when the furnace is being lighted, and should be moved to its other position after the operator believes that proper ignition has been effected.

Accordingly, if conditions continue normal after switch 15 is moved to its up position, the contacts of switch 20 will open before expiration of the time delay of relay 22 so that its contacts 23 will remain closed to retain the operating circuit for the stoker motor. Thereafter, the system will remain under the control of the aquastat 13 and the heat sensitive switch 20.

Whenever, there is not sufficient combustion to cause switch 20 to open before relay 22 operates, or to cause switch 20 to close during operation of the furnace, the relay contacts 23 will open and thus break the power circuit to motor 10. At the same time, signal light 25 will be energized to provide a visual signal that the system is not in operation. The person responsible for operation of the furnace will accordingly know that the starting procedure must be repeated, by first moving the manual switch 15 to its down position to bypass the switch 20 and relay contacts 23, relighting the furnace, and then after a sufficient short waiting period, returning switch 15 to its up position wherein the controls of the invention are again made effective.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a heating system including a stoker-fed furnace, a safety control for preventing operation of the stoker motor in the event of insufficient combustion in the furnace, comprising:

(a) thermostatic switch means for energizing and deenergizing said motor, (b) time delay means including normally closed contacts in circuit with said thermostatic switch means and said motor, (c) heat sensitive switch means including normally closed contacts in the energizing circuit for said relay means, (d) said heat sensitive switch means being located at a position in said system subject to exposure to heat emanating from said furnace and being adapted to open its said normally closed contacts in response to increase in the heat above a predetermined value which is representative of sufficient fire in said furnace to maintain standby combustion therein and thereby to maintain said relay deenergized and said contacts thereof closed, and (e) said time delay relay means being adapted to maintain said normally closed contacts thereof closed for a sufficient time interval after being energized for combustion in said furnace to increase the heat at said position from standby conditions to said predetermined value.

2. The system defined in claim 1 further comprising means responsive to the opening of said normally closed relay contacts for producing a signal thereof.

3. The system defined in claim 1 further comprising manually operable switch means for bypassing said relay means and said heat sensitive switch means.

4. The system defined in claim 1, wherein said thermostatic switch is the aquastat in a hot water heating system.

5. A hot water heating system including a stoker-fed coal furnace and provided with a safety control for preventing operation of the stoker motor in the event of insufficient combustion in the furnace, comprising:

(a) thermostatic switch means responsive to the temperature of the water in said heating system for energizing and deenergizing said motor, (b) time delay relay means including normally closed contacts in circuit with said thermostatic switch means and said motor, (c) heat sensitive switch means including normally closed contacts in the energizing circuit for said relay means, (d) said heat sensitive switch means being located at a position in said system subject to exposure to heat emanating from said furnace and being adapted to open its said normally closed contacts in response to increase in the heat above a predetermined value which is representative of sufficient fire in said furnace to maintain standby combustion therein and thereby to maintain said relay deenergized and said contacts thereof closed, and (e) said time delay relay means being adapted to maintain said normally closed contacts thereof closed for a sufficient time interval after being energized for combustion in said furnace to increase the heat at said position from standby conditions to said predetermined value.

6. The system defined in claim 5 further comprising means responsive to the opening of said normally closed relay contacts for producing a signal thereof.

7. The system defined in claim 5 further comprising manually operable switch means for bypassing said relay means and said heat sensitive switch means.

8. The system defined in claim 5 further comprising manually operable switch means for bypassing said relay means and said heat sensitive switch means, and means responsive to the opening of said normally closed said relay contacts for producing a signal thereof.

* * * * *